US010414570B2

(12) United States Patent
Stelzer et al.

(10) Patent No.: US 10,414,570 B2
(45) Date of Patent: Sep. 17, 2019

(54) VACUUM PANEL FOR NON-ROUND CONTAINERS

(71) Applicant: Amcor Rigid Plastics USA, LLC, Wilmington, DE (US)

(72) Inventors: James Stelzer, South Lyon, MI (US); Rohit V. Joshi, Alpharetta, GA (US); Guizhang Zheng, Ann Arbor, MI (US); Dwayne Gannon, Tecumseh, MI (US)

(73) Assignee: AMCOR RIGID PLASTICS USA, LLC, Wilmington, DE (US)

( * ) Notice: Subject to any disclaimer, the term of this patent is extended or adjusted under 35 U.S.C. 154(b) by 47 days.

(21) Appl. No.: 15/520,001

(22) PCT Filed: Apr. 15, 2015

(86) PCT No.: PCT/US2015/025940

§ 371 (c)(1),
(2) Date: Apr. 18, 2017

(87) PCT Pub. No.: WO2016/064446

PCT Pub. Date: Apr. 28, 2016

(65) Prior Publication Data

US 2018/0297764 A1 Oct. 18, 2018

Related U.S. Application Data

(63) Continuation-in-part of application No. PCT/US2014/061894, filed on Oct. 23, 2014.

(51) Int. Cl.

| | |
|---|---|
| ***B65D 79/00*** | (2006.01) |
| ***B65D 1/40*** | (2006.01) |
| ***B65D 1/02*** | (2006.01) |

(52) U.S. Cl.
CPC ..... *B65D 79/005* (2013.01); *B65D 1/0223* (2013.01); *B65D 1/0246* (2013.01);
(Continued)

(58) Field of Classification Search
CPC ..... B65D 79/005; B65D 11/24; B65D 11/22; B65D 11/20; B65D 1/0246; B65D 1/023;
(Continued)

(56) References Cited

U.S. PATENT DOCUMENTS 5,341,946 A * 8/1994 Vailliencourt ..... B65D 1/0223 215/381
8,556,097 B2 10/2013 Mast et al.
(Continued)

OTHER PUBLICATIONS

International Search Report and Written Opinion for PCT/US2015/025940, dated Jul. 24, 2015; ISA/KR.
(Continued)

*Primary Examiner* — Robert J Hicks
(74) *Attorney, Agent, or Firm* — Harness, Dickey & Pierce, P.L.C.

(57) ABSTRACT

A container including at least one sidewall. The sidewall includes first and second vacuum panels, and a plurality of first and second ribs. The first and second vacuum panels are recessed beneath an outer surface of the sidewall. The second vacuum panel is spaced apart from, and vertically aligned with, the first vacuum panel. The plurality of first ribs protrude outward from the first vacuum panel. The plurality of second ribs protrude outward from the second vacuum panel.

18 Claims, 14 Drawing Sheets

(52) U.S. Cl.
CPC ..... *B65D 1/0276* (2013.01); *B65D 1/40* (2013.01); *B65D 2501/0036* (2013.01); *B65D 2501/0081* (2013.01)

(58) Field of Classification Search
CPC .. B65D 1/0223; B65D 1/0276; B65D 1/0261; B65D 1/42; B65D 1/40; B65D 1/44
USPC ..... 220/675, 670, 669, 674; 215/383, 382, 215/381; D9/569, 560, 559, 541, 530, D9/516
See application file for complete search history.

(56) References Cited

U.S. PATENT DOCUMENTS 8,651,307 B2 * 2/2014 Deemer ..... B65D 1/0223 215/375
2001/0054597 A1 12/2001 Ozawa et al.
2004/0022976 A1 2/2004 Kato et al.
2004/0144747 A1 * 7/2004 Saito ..... B65D 1/0223 215/379
2005/0067369 A1 * 3/2005 Trude ..... B65D 1/0223 215/381
2005/0269284 A1 * 12/2005 Pedmo ..... B65D 1/0223 215/381
2008/0105645 A1 5/2008 Boukobza
2009/0057263 A1 * 3/2009 Barker ..... B65D 1/44 215/381
2009/0321385 A1 12/2009 Oguchi et al.
2010/0155360 A1 6/2010 Mast et al.
2010/0301003 A1 12/2010 Lewis et al.
2011/0220668 A1 9/2011 Steih et al.
2012/0097635 A1 4/2012 Yourist et al.
2012/0219738 A1 8/2012 Boukobza
2013/0082024 A1 4/2013 Howell et al.
2013/0228249 A1 9/2013 Gill
2014/0138343 A1 5/2014 Joshi et al.
2015/0108081 A1 * 4/2015 Boulay ..... B65D 1/0223 215/383

OTHER PUBLICATIONS

International Search Report and Written Opinion for PCT/US2014/061694, dated Jul. 15, 2015; ISA/KR.

* cited by examiner

VACUUM PANEL FOR NON-ROUND CONTAINERS

CROSS-REFERENCE TO RELATED APPLICATION

This application is a U.S. National Phase Application under 35 U.S.C. 371 of International Application No. PCT/US2015/025940 filed on Apr. 15, 2015 and published as WO 2016/064448 A1 on Apr. 28, 2016. This application is based on and claims the benefit of priority from International Application No. PCT/US2014/061894 filed on Oct. 23, 2014. The entire disclosures of the above applications are incorporated herein by reference.

FIELD

The present disclosure relates to non-round containers having vacuum panels.

BACKGROUND

This section provides background information related to the present disclosure, and is not necessarily prior art.

As a result of environmental and other concerns, plastic containers, more specifically polyester and even more specifically polyethylene terephthalate (PET) containers, are now being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \left(\frac{\rho - \rho_a}{\rho_c - \rho_a}\right) \times 100$$

where $\rho$ is the density of the PET material; $\rho_a$ is the density of pure amorphous PET material (1.333 g/cc); and $\rho_c$ is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching an injection molded PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is cloudy or opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 250° F.-350° F. (approximately 121° C.-177° C.), and holding the blown container against the heated mold for approximately one (1) to five (5) seconds. Manufacturers of PET juice bottles, which must be hot-filled at approximately 190° F. (88° C.), currently use heat setting to produce PET bottles having an overall crystallinity in the range of approximately 25%-35%.

While current containers are suitable for their intended use, they are subject to improvement. For example, a non-round container having the following properties would be desirable: when hot filled and under pressure, the container is able to resist expansion and deformation; and when under vacuum, the container is able to absorb vacuum and resist container skewing to help the container remain square.

SUMMARY

This section provides a general summary of the disclosure, and is not a comprehensive disclosure of its full scope or all of its features.

The present teachings provide for a non-round container. The container includes a sidewall having an outer surface. A first vacuum panel is recessed beneath the outer surface and includes at least one first rib. A second vacuum panel is recessed beneath the outer surface and includes at least one second rib. A middle vacuum panel is recessed beneath the outer surface and is positioned between the first and the second vacuum panels. The middle vacuum panel includes at least one middle rib.

The present teachings further provide for a non-round container including a plurality of sidewalls. Each sidewall includes an outer surface, a first vacuum panel, a second vacuum panel, and a middle vacuum panel. The first vacuum panel is recessed beneath the outer surface and includes a plurality of first ribs. The second vacuum panel is recessed beneath the outer surface and includes a plurality of second ribs. The middle vacuum panel is recessed beneath the outer surface and is positioned between the first and the second vacuum panels. The middle vacuum panel includes a middle rib configured as an initiator to permit the first, the second, and the middle vacuum panels to flex inward when the non-round container is under vacuum. The middle vacuum panel is connected to both the first vacuum panel and the second vacuum panel. The first and the second vacuum panels are both larger than the middle vacuum panel.

The present teachings also provide for a non-round container including a plurality of sidewalls. Each sidewall includes an outer surface, an upper vacuum panel, a lower vacuum panel, and a middle vacuum panel. The upper vacuum panel is recessed beneath the outer surface and includes a plurality of upper ribs. The lower vacuum panel is recessed beneath the outer surface and includes a plurality of lower ribs. The middle vacuum panel is recessed beneath the outer surface and is positioned between the upper and the lower vacuum panels. The middle vacuum panel includes a middle rib configured as an initiator to permit the sidewalls to flex inward when the non-round container is under vacuum. The middle vacuum panel is devoid of ribs other than the middle rib. The upper and the lower vacuum panels are both larger than the middle vacuum panel. The middle vacuum panel is connected to both the upper vacuum panel and the lower vacuum panel. Each one of the upper and the lower vacuum panels are recessed further beneath the outer surface than the middle vacuum panel. Each one of the upper, lower, and middle vacuum panels have a height extending parallel to a longitudinal axis of the container. The plurality of upper ribs, the plurality of lower ribs, and the middle rib extend in a lengthwise direction perpendicular to the longitudinal axis of the container.

The present teachings also provide for a container including at least one sidewall. The sidewall includes first and second vacuum panels, and a plurality of first and second ribs. The first and second vacuum panels are recessed beneath an outer surface of the sidewall. The second vacuum panel is spaced apart from, and vertically aligned with, the first vacuum panel. The plurality of first ribs protrude outward from the first vacuum panel. The plurality of second ribs protrude outward from the second vacuum panel.

The present teachings still further provide for a container including at least one sidewall. The sidewall includes first and second vacuum panels, and a plurality of first and second ribs. The first and second vacuum panels are recessed beneath an outer surface of the sidewall. The second vacuum panel is spaced apart from, and vertically aligned with, the first vacuum panel. An intermediate rib is between the first and the second vacuum panels, and extends inward from the outer surface. The plurality of first ribs have varying lengths and protrude from the first vacuum panel such that a longest one of the plurality of first ribs is closest to the intermediate rib. The plurality of second ribs have varying lengths and protrude from the second vacuum panel such that a longest one of the plurality of second ribs is closest to the intermediate rib.

The present teachings provide for a container including at least one sidewall having first and second vacuum panels, and a plurality of first and second ribs. The first vacuum panel is recessed beneath an outer surface of the sidewall. The second vacuum panel is recessed beneath the outer surface of the sidewall. The second vacuum panel is spaced apart from, and vertically aligned with, the first vacuum panel. The plurality of first ribs protrude outward from the first vacuum panel. The plurality of second ribs protrude outward from the second vacuum panel. The sidewall is convex in a lengthwise direction at the outer surface thereof, and is convex in a widthwise direction at the outer surface thereof. The container is larger than 18.5 ounces.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
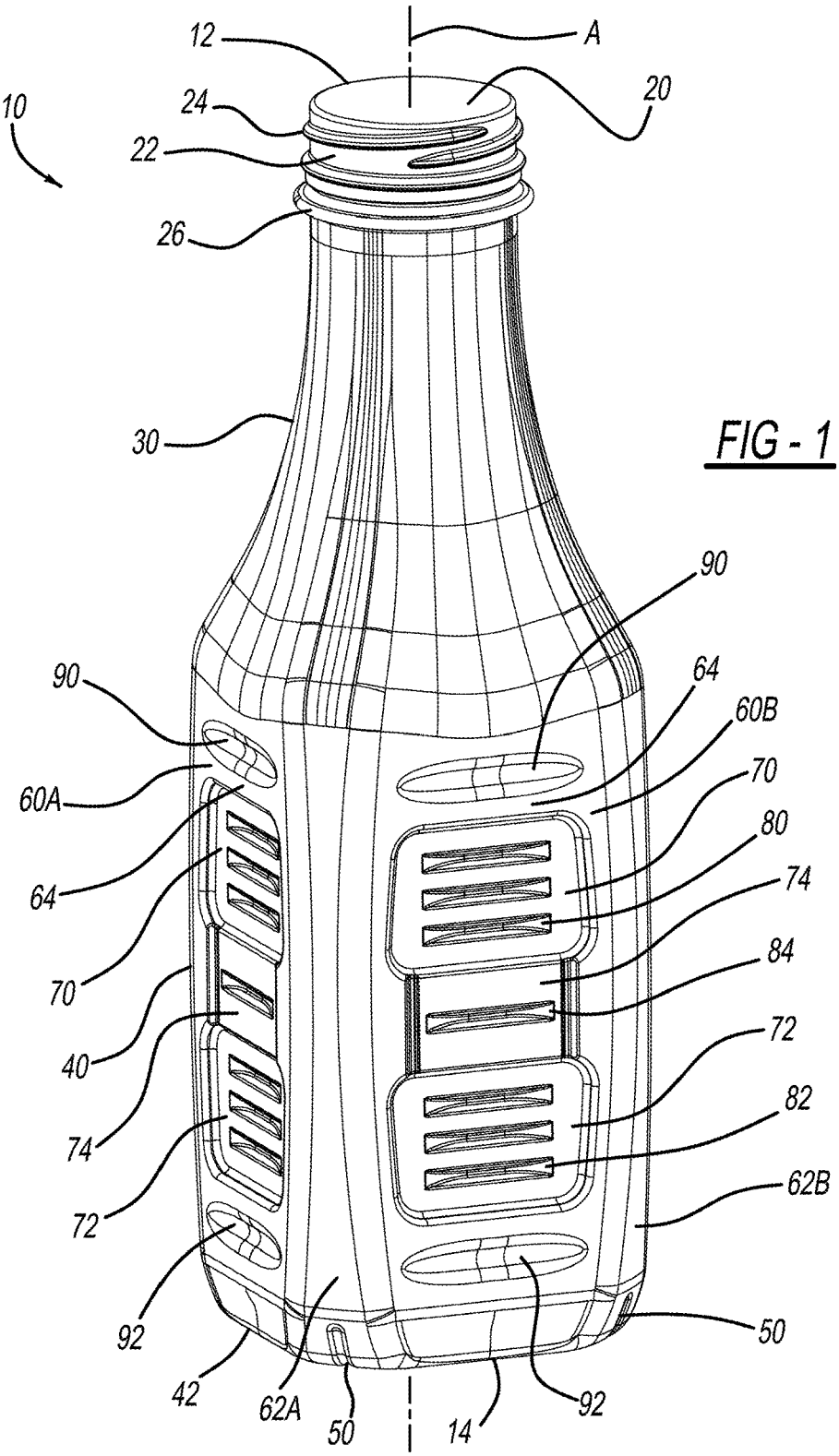
FIG. 1 is a perspective view of a container according to the present teachings.
Figure 2:
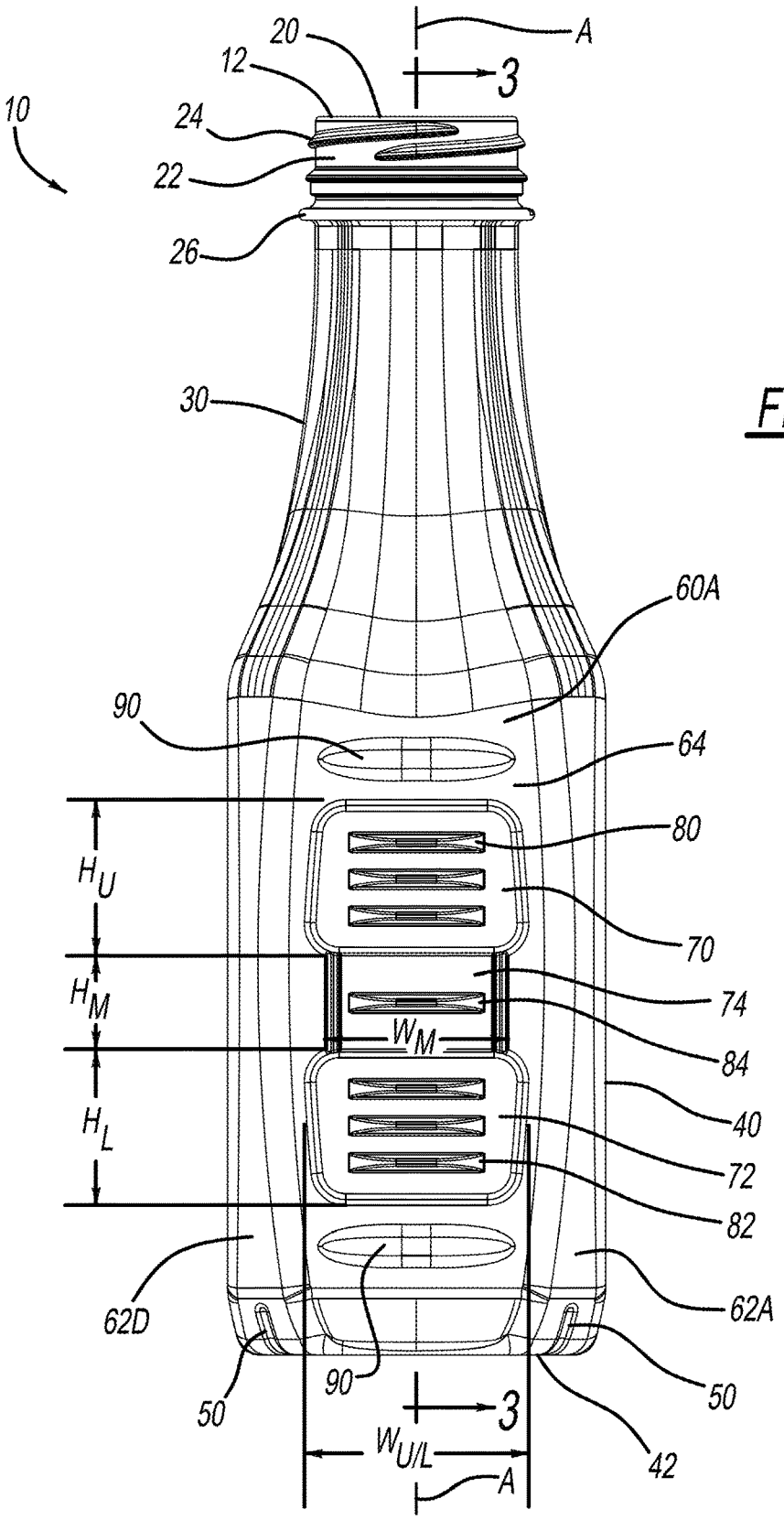
FIG. 2 is a side view of the container of FIG. 1.

With initial reference to FIGS. 1 and 2, a container according to the present teachings is illustrated at reference numeral 10. The container 10 can be any suitable non-round container of any suitable shape or size. For example, the container 10 can be substantially rectangular or substantially square, as illustrated. The container 10 can also, for example, be triangular, pentagonal, hexagonal, octagonal, or polygonal, which may have different dimensions and volume capacities. Other modifications can be made to the container 10 depending on the specific application and environmental requirements.

The container 10 can be a hot-filled container made from any suitable material, such as any suitable blow-molded thermoplastic, including PET, LDPE, HDPE, PP, TS, and the like. The container 10 can be of any suitable size, such as 18.5 ounces, and can be configured to be hot-filled with any suitable commodity, such as water, tea, or juice.

The commodity may be in any form, such as a solid or semi-solid product. In one example, a commodity may be introduced into the container 10 during a thermal process, typically a hot-fill process. For hot-fill bottling applications, bottlers generally fill the container 10 with a product at an elevated temperature between approximately 155° F. to 205° F. (approximately 68° C. to 96° C.) and seal the container 10 with a closure (not illustrated) before cooling. In addition, the container 10 may be suitable for other high-temperature pasteurization or retort filling processes or other thermal processes as well. In another example, the commodity may be introduced into the container 10 under ambient temperatures.

The container 10 can be a blow molded, biaxially oriented container with a unitary construction from a single or multi-layer material. A well-known stretch-molding, heat-setting process for making the container 10 generally involves the manufacture of a preform (not shown) of a polyester material, such as polyethylene terephthalate (PET), having a shape well known to those skilled in the art similar to a test-tube with a generally cylindrical cross section.

A preform version of container 10 includes a support ring 26, which may be used to carry or orient the preform through and at various stages of manufacture. For example, the preform may be carried by the support ring 26, the support ring 26 may be used to aid in positioning the preform in a mold cavity, or the support ring 26 may be used to carry an intermediate container once molded. At the outset, the preform may be placed into the mold cavity such that the support ring 26 is captured at an upper end of the mold cavity. In general, the mold cavity has an interior surface corresponding to a desired outer profile of the container 10.

In one example, a machine (not illustrated) places the preform heated to a temperature between approximately 190° F. to 250° F. (approximately 88° C. to 121° C.) into the mold cavity. The mold cavity may be heated to a temperature between approximately 250° F. to 350° F. (approximately 121° C. to 177° C.). A stretch rod apparatus (not illustrated) stretches or extends the heated preform within the mold cavity to a length approximately that of the intermediate container thereby molecularly orienting the polyester material in an axial direction generally corresponding with the central longitudinal axis of the container 10. While the stretch rod extends the preform, air having a pressure between 300 PSI to 600 PSI (2.07 MPa to 4.14 MPa) assists in extending the preform in the axial direction and in expanding the preform in a circumferential or hoop direction thereby substantially conforming the polyester material to the shape of the mold cavity and further molecularly orienting the polyester material in a direction generally perpendicular to the axial direction, thus establishing the biaxial molecular orientation of the polyester material in most of the intermediate container. The pressurized air holds the mostly biaxial molecularly oriented polyester material against the mold cavity for a period of approximately one (1) to five (5) seconds before removal of the intermediate container from the mold cavity. This process is known as heat setting and results in the container 10 being suitable for filling with a product at high temperatures.

Other manufacturing methods may be suitable for manufacturing the container 10. For example, extrusion blow molding, one step injection stretch blow molding, and injection blow molding, using other conventional materials including, for example, high density polyethylene, polypropylene, polyethylene naphthalate (PEN), a PET/PEN blend or copolymer, and various multilayer structures may be suitable for manufacturing the container 10. Those having ordinary skill in the art will readily know and understand plastic container manufacturing method alternatives.

The container 10 generally includes a first end 12 and a second end 14, which is opposite to the first end 12. A longitudinal axis A of the container 10 extends between the first end 12 and the second end 14 through an axial center of the container 10. At the first end 12, an opening 20 is generally defined by a finish 22 of the container 10. Extending from an outer periphery of the finish 22 are threads 24, which are configured to cooperate with corresponding threads of any suitable closure in order to close the opening 20, and thus close the container 10. Extending from an outer periphery of the container 10 proximate to the finish 22, or at the finish 22, is the support ring 26. The support ring 26 can be used to couple with a blow molding machine for blow molding the container 10 from a preform, for example, as explained above.

Extending from the finish 22 is a neck 30 of the container 10. The neck 30 generally and gradually slopes outward and away from the longitudinal axis A as the neck 30 extends down and away from the finish 22 towards the second end 14 of the container 10. The neck 30 extends to a body 40 of the container 10. The body 40 extends from the neck 30 to a base 42 of the container 10 at the second end 14 of the container 10.

Figure 3:
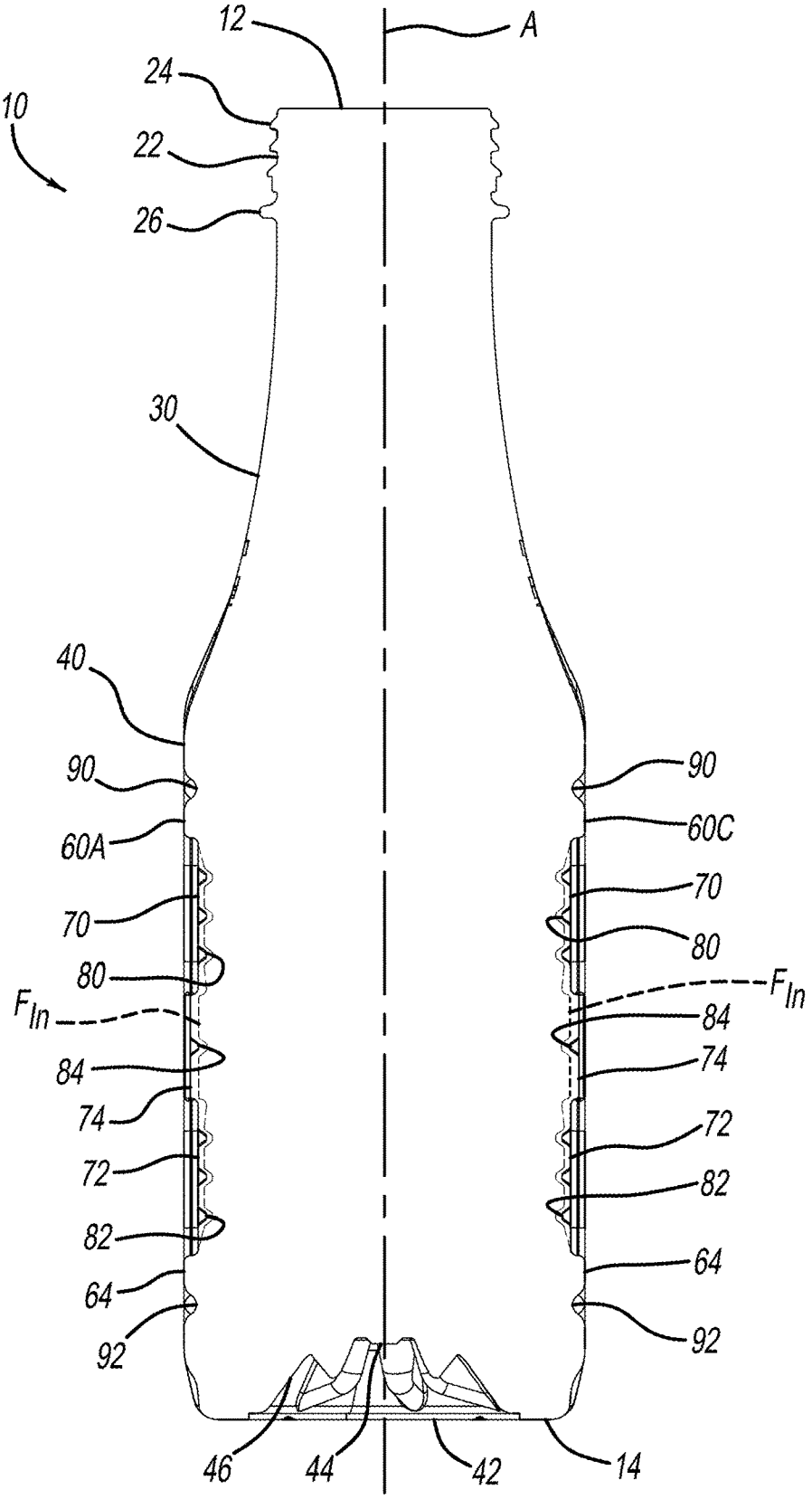
FIG. 3 is a cross-sectional view of the container taken along line 3-3 of FIG. 2.
Figure 4:
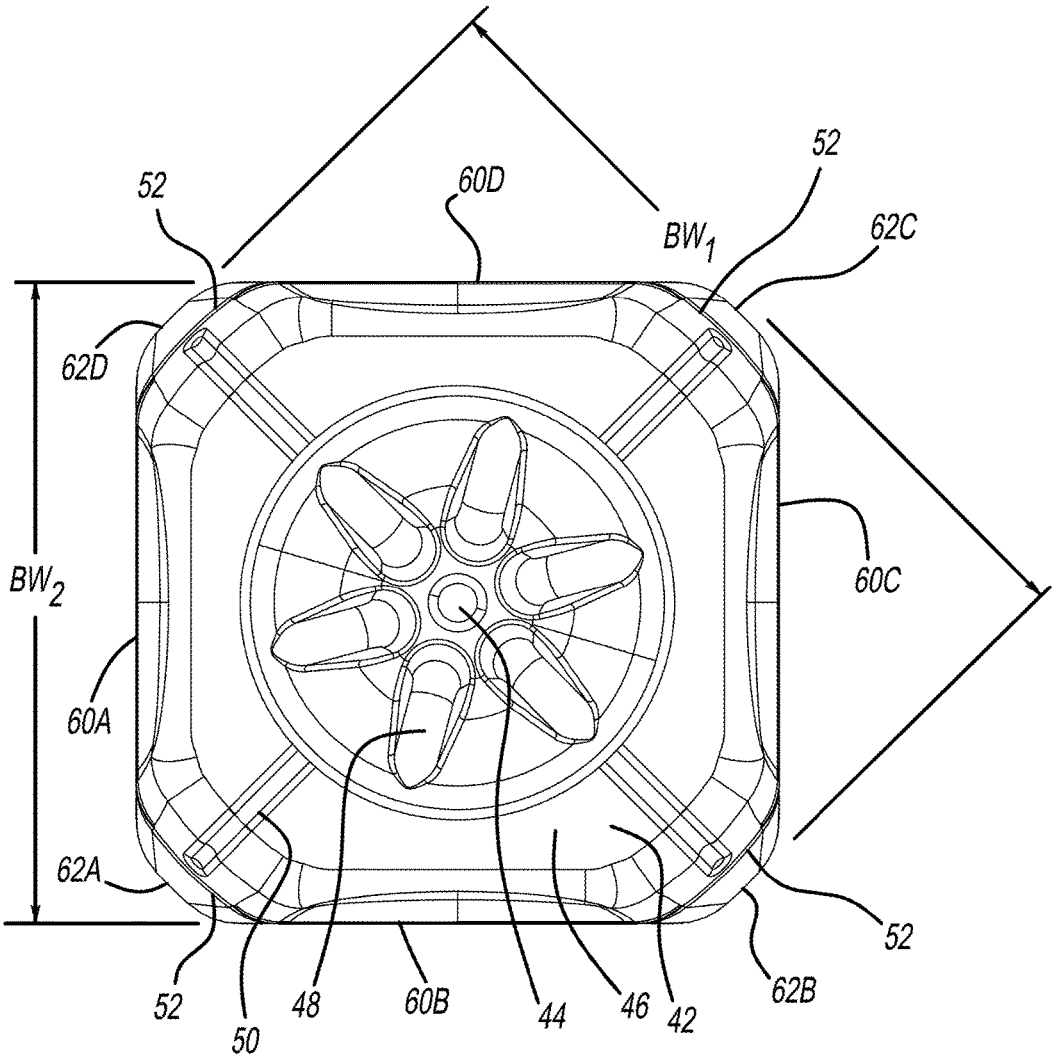
FIG. 4 is a bottom view of the container.
Figure 5:
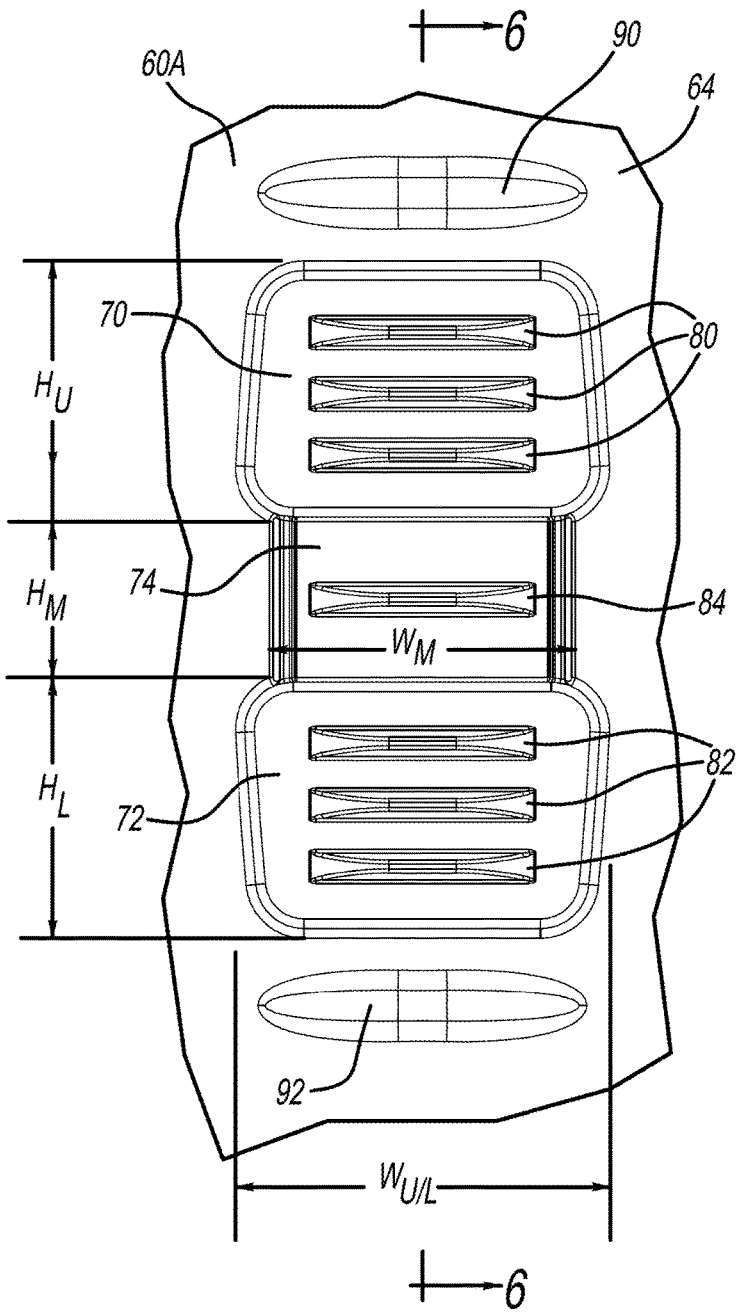
FIG. 5 is a close-up view of side panels of a sidewall of the container.
Figure 6:
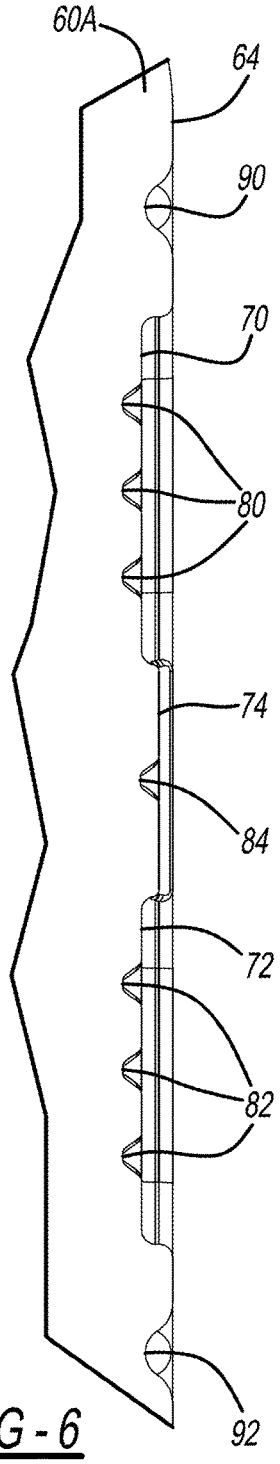
FIG. 6 is a cross-sectional view taken along line 6-6 of FIG. 5.

With additional reference to FIGS. 3 and 4, the base 42 will now be described. The base 42 generally includes a central push-up portion 44. The longitudinal axis A extends through a center of the central push-up portion 44. Surrounding the central push-up portion 44, and extending radially outward therefrom, is a diaphragm 46. The base 42 can include any suitable strengthening features, such as center ribs 48. The center ribs 48 are spaced apart and generally extend outward from the central push-up portion 44. Outer ribs 50 may also be included. The outer ribs 50 generally extend across the diaphragm 46 to, or proximate to, corners 52 of the base 42. The outer ribs 50 can extend beyond the corners 52 to chamfered edges 62A-62D, as illustrated in FIGS. 1 and 2 for example. Each one of the center ribs 48 and the outer ribs 50 may be recessed within the base 42.

The central push-up portion 44 and the diaphragm 46 of the base 42 are configured to move towards and away from the first end 12 to help the container 10 maintain its overall shape as the container 10 is hot-filled and subsequently cools. For example, when the container 10 is hot-filled and under pressure, the central push-up portion 44 and the diaphragm 46 are configured to move along the longitudinal axis A away from the first end 12. When the container 10 cools and is under vacuum, the central push-up portion 44 and the diaphragm 46 are configured to move back towards the first end 12, such as to a position closer to the first end 12 as compared to an as-blown position.

The body 40 of the container 10 can include any suitable number of sidewalls. For example and as illustrated, the body 40 can include a first sidewall 60A, a second sidewall 60B, a third sidewall 60C, and a fourth sidewall 60D. Between each sidewall 60A-60D is one of a plurality of chamfered edges 62A-62D. For example and as illustrated in FIG. 4, between the first sidewall 60A and the second sidewall 60B is a first chamfered edge 62A. Between the second sidewall 60B and the third sidewall 60C is a second chamfered edge 62B. Between the third sidewall 60C and the fourth sidewall 60D is a third chamfered edge 62C. Between the fourth sidewall 60D and the first sidewall 60A is a fourth chamfered edge 62D. The chamfered edges 62A-62D can connect the sidewalls 60A-60D that each chamfered edge 62A-62D is between.

With reference to FIGS. 1-3, 5, and 6 for example, each one of the sidewalls 60A-60D includes an outer surface 64. Recessed beneath each outer surface 64 are a plurality of vacuum panels, such as a first or upper panel 70, a second or lower panel 72, and a middle panel 74, which is between the upper and lower panels 70 and 72. The middle panel 74 can be connected to each one of the upper and lower panels 70 and 72. The upper panel 70, the lower panel 72, and the middle panel 74 each extend parallel to the longitudinal axis A, although the upper and lower panels 70 and 72 are recessed slightly further beneath the outer surface 64 as compared to the middle panel 74. The upper and lower panels 70 and 72 are recessed equidistant beneath the outer surface 64. Of the upper panel 70, the lower panel 72, and the middle panel 74, the upper panel 70 is closest to the first end 12 and the lower panel 72 is closest to the second end 14. The upper and lower panels 70 and 72 are generally mirror images on opposite sides of the middle panel 74.

The upper panel 70 includes one or more upper panel ribs 80 and the lower panel 72 includes one or more lower panel ribs 82. The upper and lower panel ribs 80 and 82 can be configured in any suitable manner to permit the upper and lower panels 70 and 72 to flex inward in response to a vacuum, and outward in response to the container 10 being subject to increased internal pressure. Any suitable number of the upper and lower panel ribs 80 and 82 can be included, and the number of upper panel ribs 80 can be different than the number of lower panel ribs 82. For example and as illustrated, three upper panel ribs 80 and three lower panel ribs 82 are included. The upper and lower panel ribs 80 and 82 each extend into the upper and lower panels 70 and 72 respectively, such as towards the longitudinal axis A. The upper and lower panel ribs 80 and 82 extend lengthwise in a direction generally perpendicular to the longitudinal axis.

The middle panel 74 can include any suitable number of ribs as well, such as a single middle panel rib 84 as illustrated. The middle panel rib 84 extends into the middle panel 74 towards the longitudinal axis A. The middle panel rib 84 extends lengthwise in a direction generally perpendicular to the longitudinal axis A across a width of the middle panel 74. When the container 10 is under vacuum, the middle panel rib 84 acts as an initiator to allow the middle panel 74, as well as the upper and lower panels 70 and 72, to flex inward as illustrated in FIG. 3 at $F_{in}$ in order to absorb the vacuum pressure, which helps the container 10 to resist skewing and maintain its intended shape. When the container 10 is under increased internal pressure, the upper, lower, and middle panels 70, 72, and 74 can expand outward (away from the longitudinal axis A in a direction opposite to $F_{in}$) to help the container sidewalls 60A-60D resist expansion and deformation. The middle panel 74 is generally a bridge panel that is configured to act as a strap to resist expansion of the sidewalls 60A-60D when the container 10 is filled under pressure.

Each one of the first, second, third, and fourth sidewalls 60A-60D can include the panels 70, 72, and 74, as well as the ribs 80, 82, and 84, described above in the same or substantially similar configuration. The panels 70, 72, and 74, as well as the ribs 80, 82, and 84, can be scalable for different sized containers.

Each sidewall 60A-60D can further include an upper rib 90 and a lower rib 92. The upper rib 90 is recessed into the outer surface and is located between the upper panel 70 and the neck 30. The lower rib 92 is also recessed into the outer surface 64, and is between the lower panel 72 and the base 42. The upper and lower rib 90 and 92 extend lengthwise in a direction that is generally perpendicular to the longitudinal axis A. The upper and lower ribs 90 and 92 further allow the sidewalls 60A-60D to resist expansion and deformation when under pressure, and absorb vacuum forces in order to resist container skewing, thereby helping the container 10 maintain its intended shape.

The features of the container 10 can be provided at any suitable dimension, and any suitable relative dimension with respect to other features. For example and with reference to FIG. 4, the base 42 can have a maximum base width $BW_1$ that is greater than a maximum base width $BW_2$ at a ratio of 1.25:1, such that the maximum base width $BW_1$ is 0.25 times greater than the maximum base width $BW_2$. The maximum base width $BW_1$ is measured between opposing chamfered edges 62A-62D of the container 10, such as between chamfered edge 62B and chamfered edge 62D as illustrated in FIG. 4. The maximum base width $BW_2$ can be measured between opposing sidewalls 60A-60D of the container 10, such as between second sidewall 60B and fourth sidewall 60D as illustrated in FIG. 4.

With respect to the upper and lower panels 70 and 72, they can each be provided at a maximum width to maximum height ratio of 1.5:1. Thus a maximum width $W_{U/L}$ of each of the upper and lower panels 70 and 72 is 0.5 times greater than a maximum height $H_U$ and $H_L$ of each one of the upper and lower panels 70 and 72 respectively.

With respect to the middle panel 74, the middle panel 74 can be provided with a maximum width to maximum height ratio of 1.7:1. Thus a maximum width $W_M$ of the middle panel 74 is 0.7 times greater than a maximum height $H_M$ of the middle panel 74. The upper and lower panels 70 and 72 each include a maximum width $W_{U/L}$ and maximum height $H_{U/L}$ that is greater than the maximum width $W_M$ and maximum height $H_M$ of the middle panel 74.

With respect to the maximum panel area of the upper, lower, and middle panels 70, 72, and 74, each one of the upper and lower panels 70 and 72 can be provided at a ratio with respect to the middle panel 74 of 1.8:1. Thus, the maximum area of each one of the upper and lower panels 70 and 72 is 0.8 times greater than the maximum area of the middle panel 74. Accordingly, the ratio of the combined maximum area of the upper and lower panels 70 and 72 with respect to the middle panel 74 is 3.6:1. In other words, the combined maximum areas of the upper and lower panels 70 and 72 is 3.6 times greater than the maximum area of the middle panel 74. The maximum areas of the upper, lower, and middle panels 70, 72, and 74 are the maximum surface areas thereof at an exterior of the container 10 extending to an outer perimeter of the panels 70, 72, and 74, and include any radii connecting the panels 70, 72, 74 to the outer surface 64 of the body 40, as well as any ribs 80, 82, 84 that are present.

Figure 7:
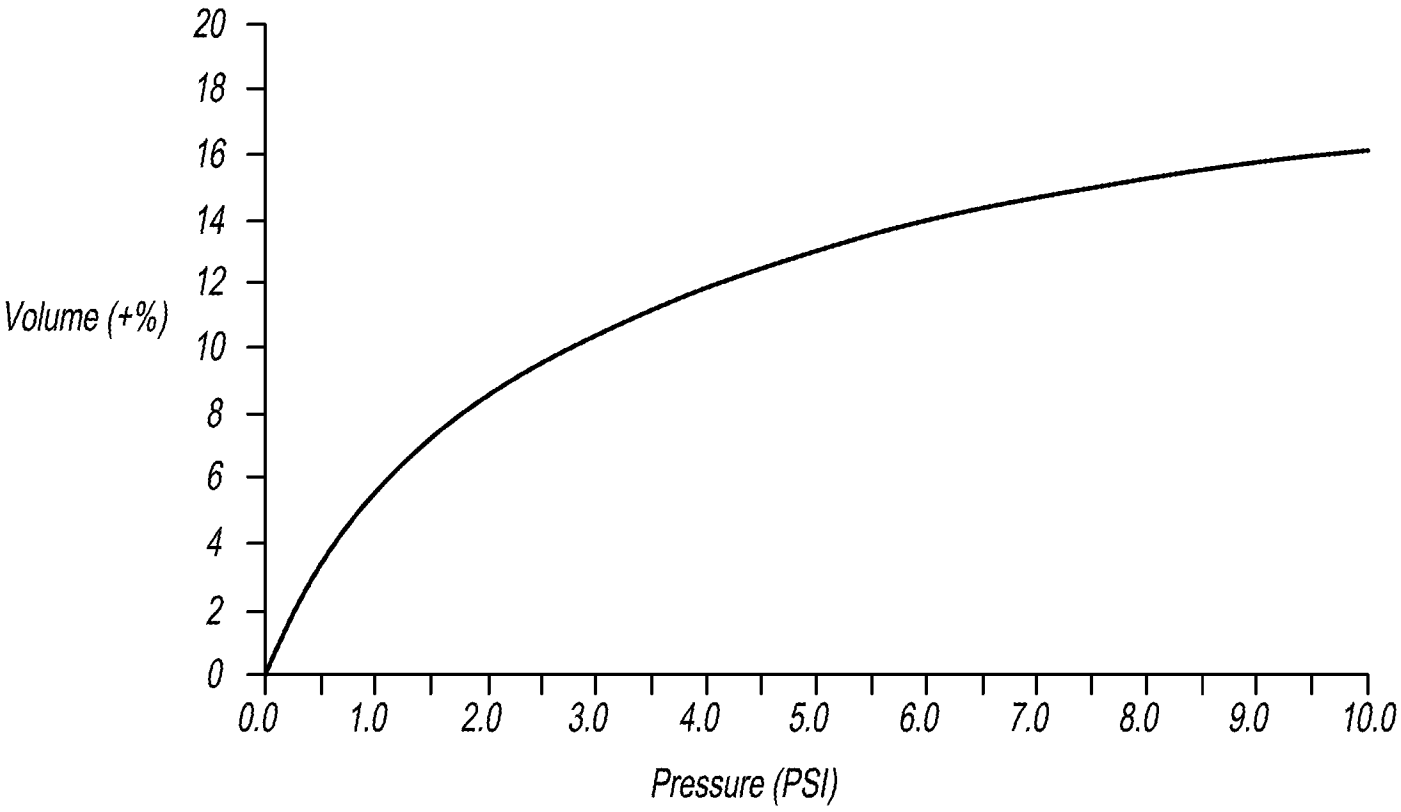
FIG. 7 is a graph showing changes in volume of the container of FIG. 1 when under different pressures.

With reference to FIG. 7, the features of the container 10 described above, such as the upper, lower, and middle panels 70, 72, and 74, provide the container 10 with enhanced pressure response properties. For example, upon being subject to an internal pressure of 2.0 PSI, the container 10 exhibits volume expansion of between 8.5% and 9.0%, such as 8.79%. At internal pressure of 5.0 PSI, the container 10 undergoes volume expansion of about 13%.

The present teachings thus advantageously provide for a container 10 that, when subject to internal vacuum pressure, the upper and lower panels 70 and 72, and particularly the middle panel 74, absorb the vacuum and resist container skewing, thereby allowing the container 10 to maintain its intended shape. The panels 70, 72, and 74 also allow the container 10 to resist expansion and deformation, such as at the sidewalls 60A-60D, when hot-filled and under pressure.

While the container 10 is suitable for its intended use, it can be difficult for the container 10 to withstand internal pressures under some circumstances. For example, the container 10 may be unable to adequately withstand internal pressure when the container 10 is provided at sizes greater than 18.5 ounces, such as 64 ounces. Lightweight hot-fill containers of all sizes must meet various industry performance standards to be acceptable for use. It becomes increasingly difficult to meet such standards as containers, such as the container 10, are made larger with thinner sidewalls. The challenge is even greater when the containers are not round or cylindrical. The underlying challenge is to balance vacuum uptake capability with rigidity sufficient to resist internal pressures. Large containers, such as 64 ounce containers, have larger absolute vacuum displacement requirements and thus larger flexible panels, such as the flexible panels 70 and 72 of container 10 described above. Pressure is experienced by the flexible panels and walls during filling, or due to expansion of air inside the container after being filled with a hot product and capped. Because the forces exerted by vacuum and internal pressures are in opposite directions, it is difficult to attain a balance such that the paneled walls can move both inward and outward without deforming permanently outward before cooling and vacuum uptake take place. Generally the same challenges are faced by ultra-lightweight single serve containers.

The present teachings provide for an additional container 110 (FIGS. 8-13), which addresses the issues set forth above, as well as numerous others. The container 110 is able to meet industry performance standards at larger sizes, such as at 64 ounces for example. The container 110 can have any suitable shape or size. For example, the container 110 can be a generally square container as illustrated, or can be round, rectangular, triangular, pentagonal, hexagonal, octagonal, or polygonal, for example. The container 110 can be a hot-fill container made from any suitable material, such as any suitable blow-molded thermal plastic, including PET, LDPE, HDPE, PP, TS, and the like. The container 110 can be of any suitable size. For example, the container 110 can be greater than 18.5 ounces, such as 64 ounces. The container 110 can be configured to be hot-filled with any suitable commodity, such as water, tea, or juice. The commodity may be in any form, such as a solid or semi-solid product. The container 110 may be filled with the commodity using the hot-fill process described above in connection with the container 10, or any other suitable thermal process.

The container 110 can be formed in any suitable manner. For example, the container 110 can be a blow-molded, biaxially oriented container with a unitary construction from a single or multi-layer material. The container 110 can be blow-molded from a preform of a polyester material, for example, such as PET as described above in conjunction with the description of the container 10. Any other suitable method of manufacturing the container 110 can be used as well.

Figure 8:
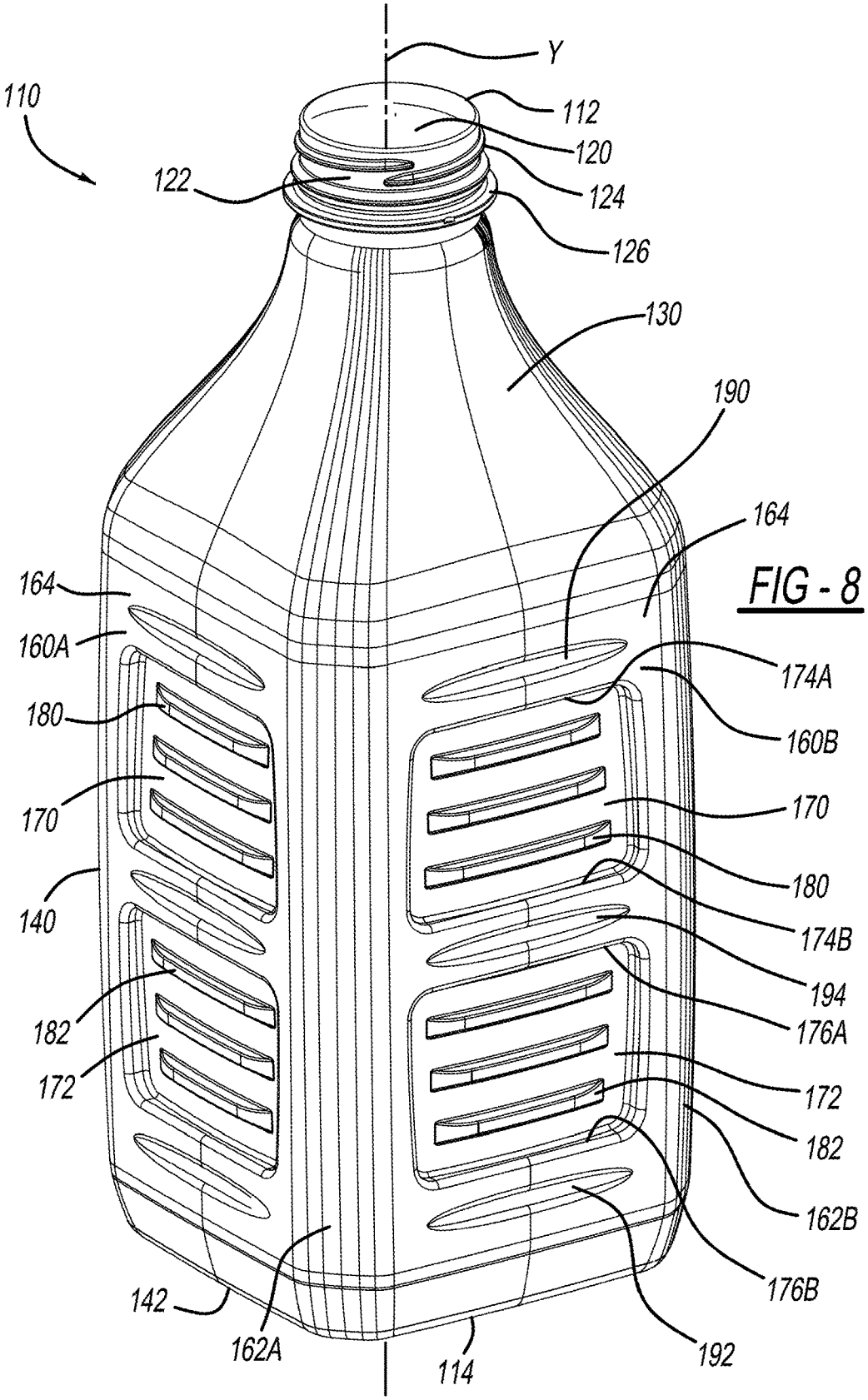
FIG. 8 is a perspective view of another container according to the present teachings.
Figure 9:
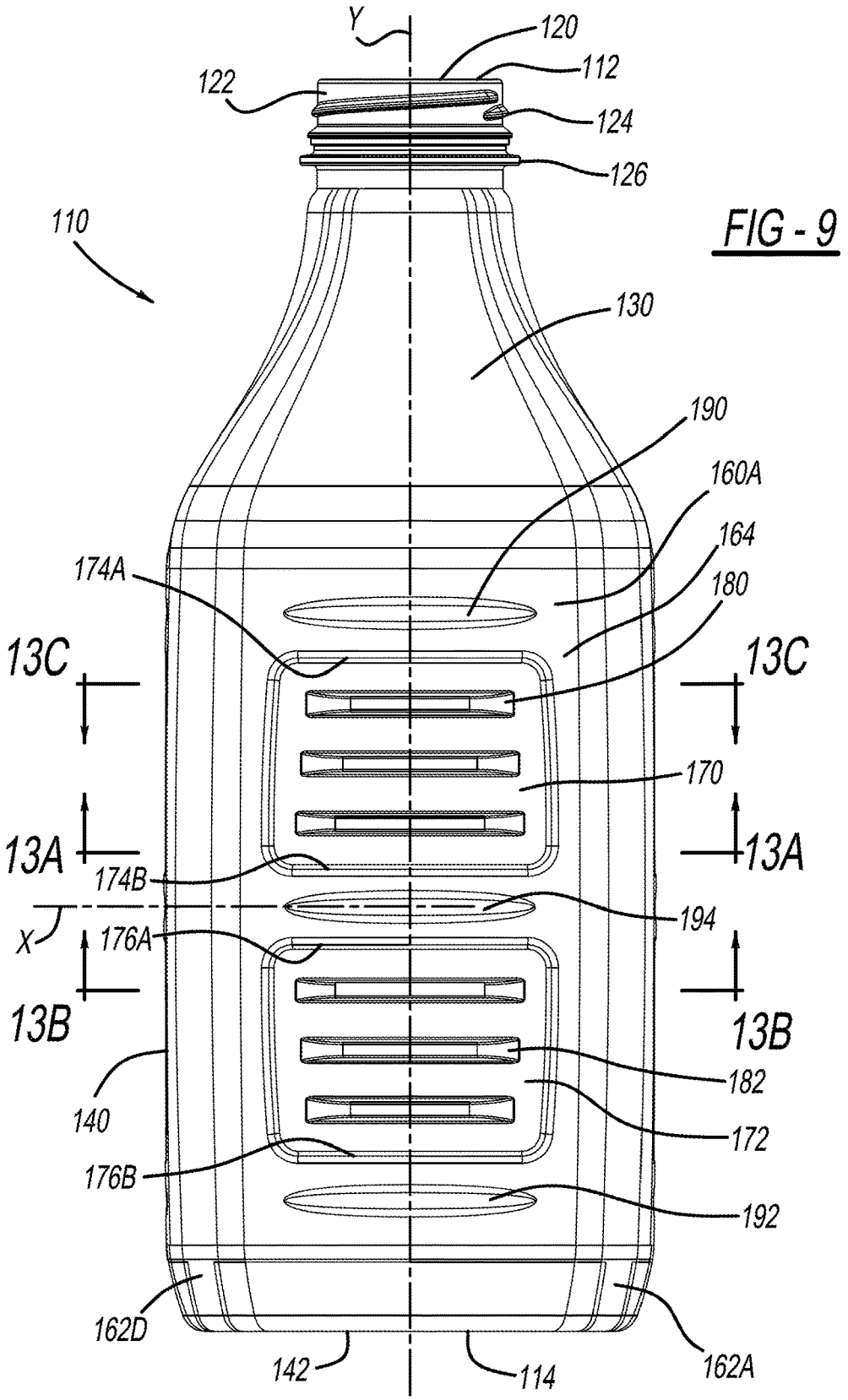
FIG. 9 is a side view of the container of FIG. 8.

As illustrated in FIGS. 8 and 9, for example, the container 110 generally includes a first end 112 and a second end 114, which is opposite to the first end 112. A longitudinal axis Y of the container 10 extends between the first end 112 and the second end 114 through an axial center of the container 110. At the first end 112, an opening 120 is generally defined by a finish 122 of the container 110. Extending from an outer periphery of the finish 122 are threads 124, which are configured to cooperate with corresponding threads of any suitable closure in order to close the opening 120, and thus close the container 110. Extending from an outer periphery of the container 110 proximate to the finish 122, or at the finish 122, is a support ring 26. The support ring 26 can be used to couple a preform of the container 110 to a blow-molding machine for blow-molding the container 10 from a preform, for example.

Extending from the finish 122 is a neck 130 of the container 110. The neck 130 generally and gradually slopes outward and away from the longitudinal axis Y as the neck 130 extends down and away from the finish 122 towards the second end 114 of the container 110. The neck 130 extends to a body 140 of the container 110. The body 140 extends from the neck 130 to a base 142 of the container 110 at the second end 114 of the container 110. A horizontal axis X (FIG. 9) extends through the longitudinal axis Y along a plane orthogonal to the longitudinal axis Y at generally a midpoint of the body 140.

With additional reference to FIG. 10, the base 142 will now be described. The base 142 generally includes a central push-up portion 144. The longitudinal axis Y extends through a center of the central push-up portion 144. Surrounding the central push-up portion 144, and extending radially outward therefrom, is a diaphragm 146. The base 142 can include any suitable strengthening features, such as center ribs 148. The center ribs 148 are spaced apart and generally extend outward from the central push-up portion 144. The base 142 may include any additional suitable strengthening features. For example, the base 142 may include outer ribs, such as the outer ribs 50 of the container 10, arranged between the diaphragm 146 and an outermost perimeter of the base 142. The central push-up portion 144 and the diaphragm 146 of the base 142 are configured to move towards and away from the first end 112 to help the container 110 maintain its overall shape as the container 110 is hot-filled and subsequently cools.

Figure 10:
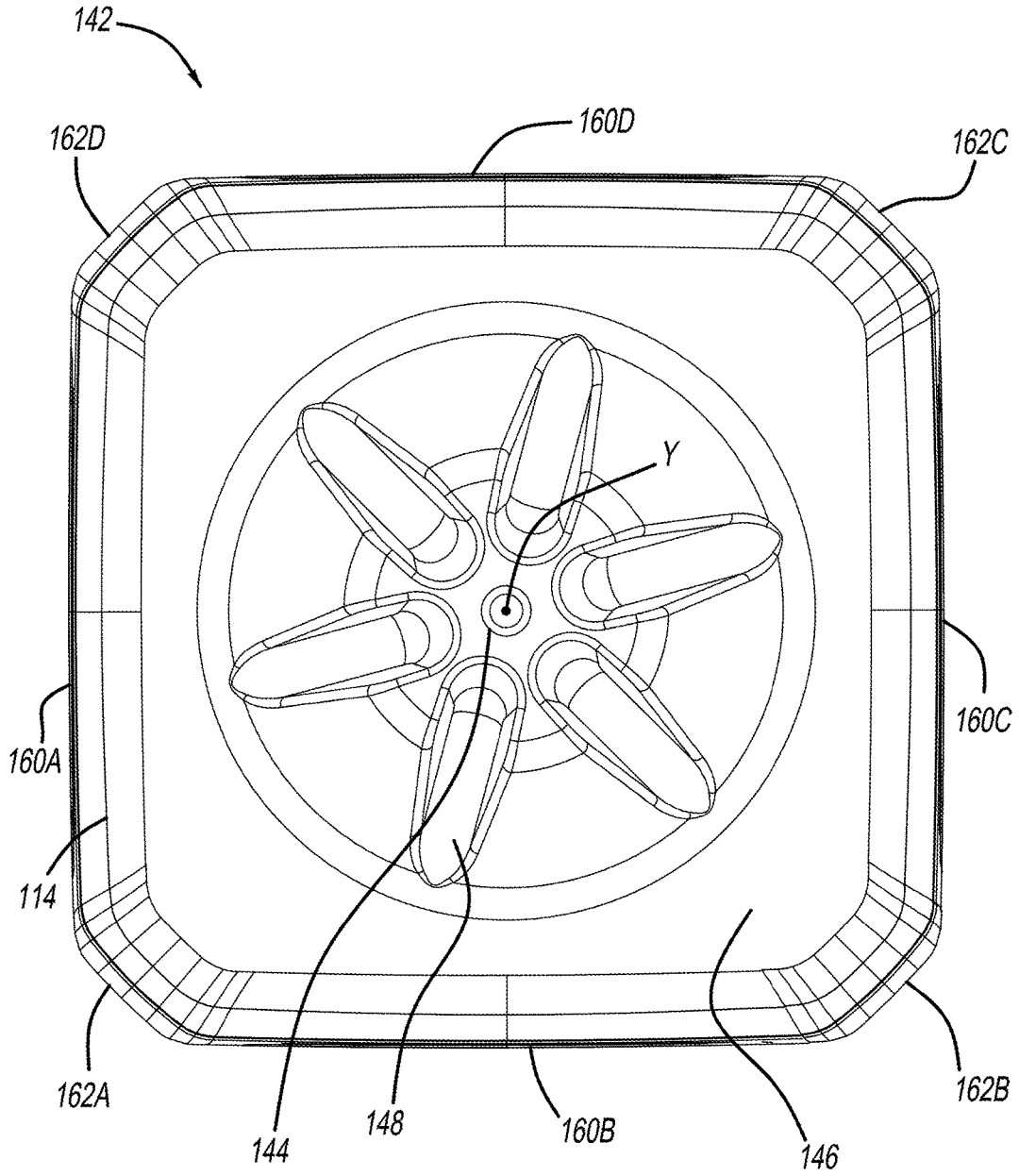
FIG. 10 is a bottom view of the container of FIG. 8.
Figure 11:
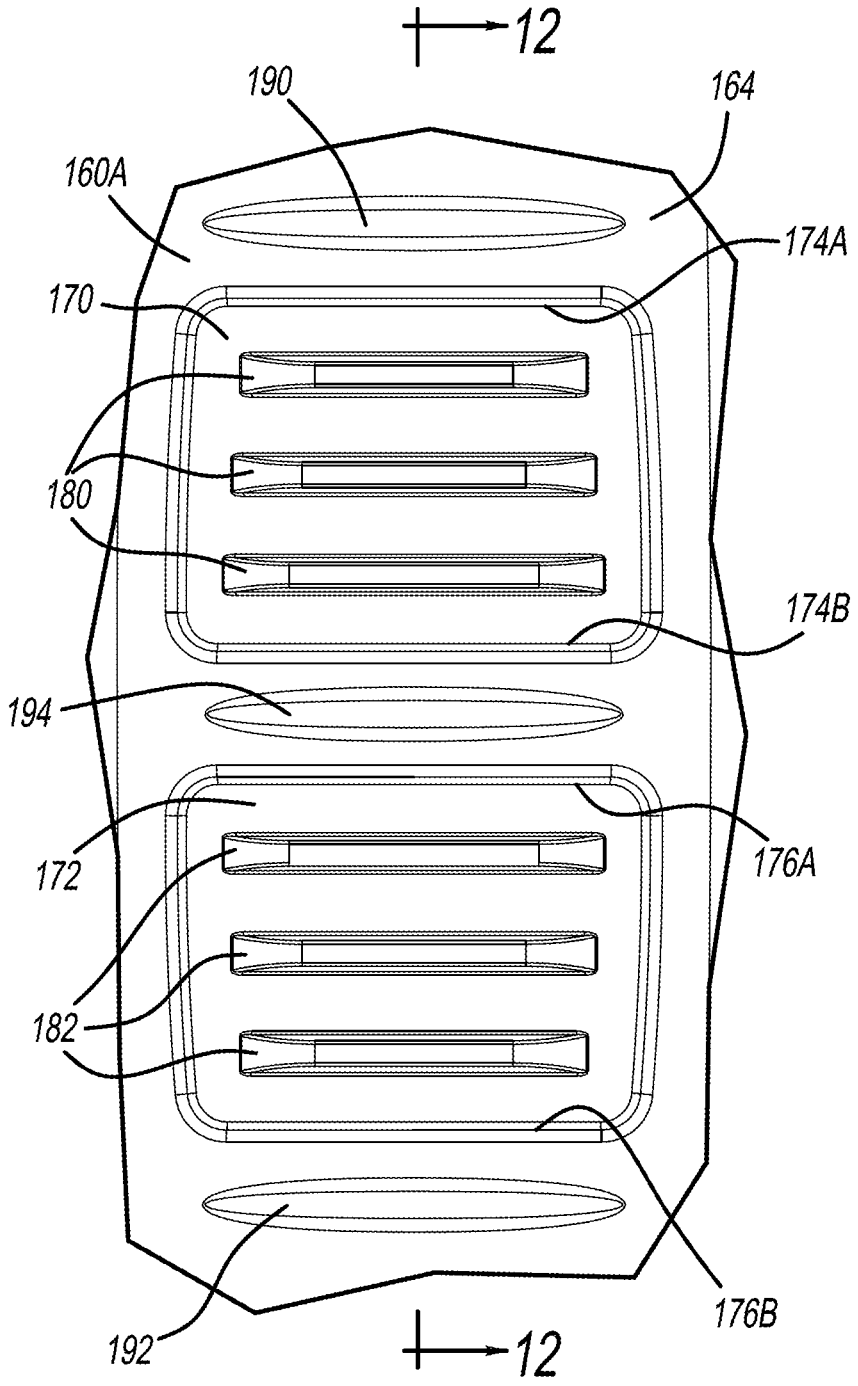
FIG. 11 is a close-up view of side panels of a sidewall of the container of FIG. 8.

With continued reference to FIGS. 8 through 10, the body 140 of the container 110 can include any suitable number of sidewalls. For example and as illustrated, the body 140 can include a first sidewall 160A, a second sidewall 160B, a third sidewall 160C, and a fourth sidewall 160D. The sidewalls 160A-160D can be connected by edges 162A-162D that can be chamfered and/or have a curve radius. For example, between the first sidewall 160A and the second sidewall 160B is a first chamfered edge 162A. Between the second sidewall 160B and the third sidewall 160C is a second chamfered edge 162B. Between the third sidewall 160C and the fourth sidewall 160D is a third chamfered edge 162C. Between the fourth sidewall 160D and the first sidewall 160A is a fourth chamfered edge 162D.

With reference to FIGS. 8, 9, 11, and 12, for example, each one of the sidewalls 160A-160D includes an outer surface 164. Recessed beneath each outer surface 164 are a plurality of vacuum panels, such as a first or upper panel 170 and a second or lower panel 172. The upper and lower panels 170 and 172 are separate and vertically spaced apart from one another. The upper panel 170 is closer to the neck 130 than the lower panel 172, and the lower panel 172 is closer to the second end 114 than the upper panel 170.

The upper and lower panels 170 and 172 can have any suitable size and shape. For example, and as illustrated, the upper and lower panels 170 and 172 can be mirror images of one another and can each have a generally trapezoid shape that is widest proximate to horizontal axis B (FIGS. 9 and 12) at the center of the body 140. Thus the upper panel 170 is most narrow at an upper end 174A thereof, and widest at a lower end 174B thereof that is proximate to the horizontal axis B. The upper panel 170 generally tapers outward from the upper end 174A to the lower end 174B. Conversely, the lower panel 172 is widest at an upper end 176A thereof proximate to the horizontal axis B, and most narrow at a lower end 176B thereof. The lower panel 172 generally tapers inward from the upper end 176A to the lower end 176B.

Figure 13A:
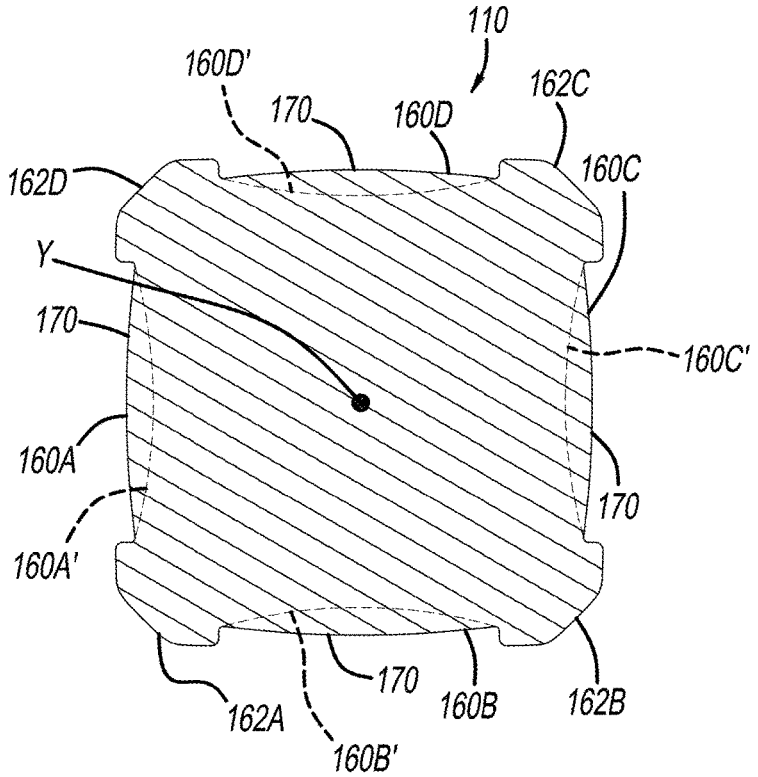
FIG. 13A is a cross-sectional view taken along line 13A-13A of FIG. 9.
Figure 13B:
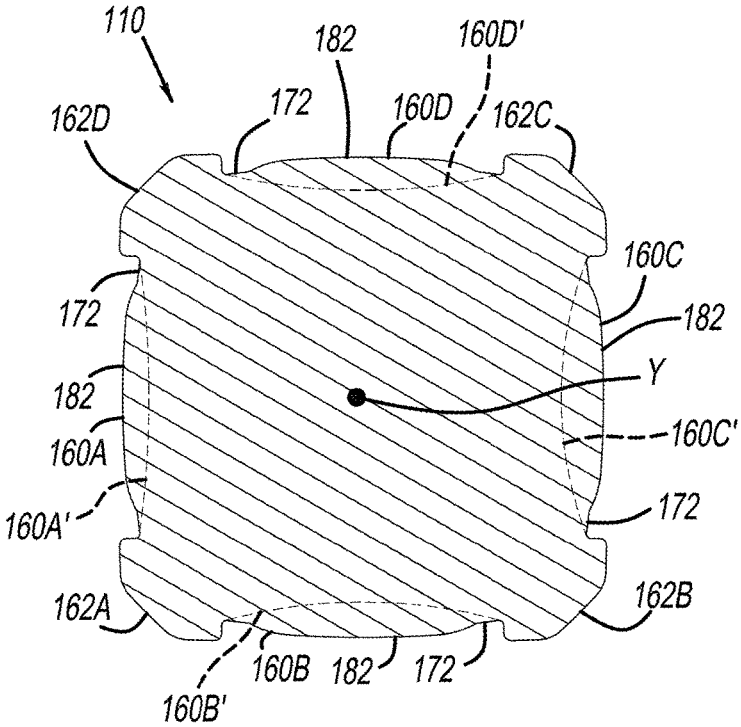
FIG. 13B is a cross-sectional view taken along line 13B-13B of FIG. 9.
Figure 13C:
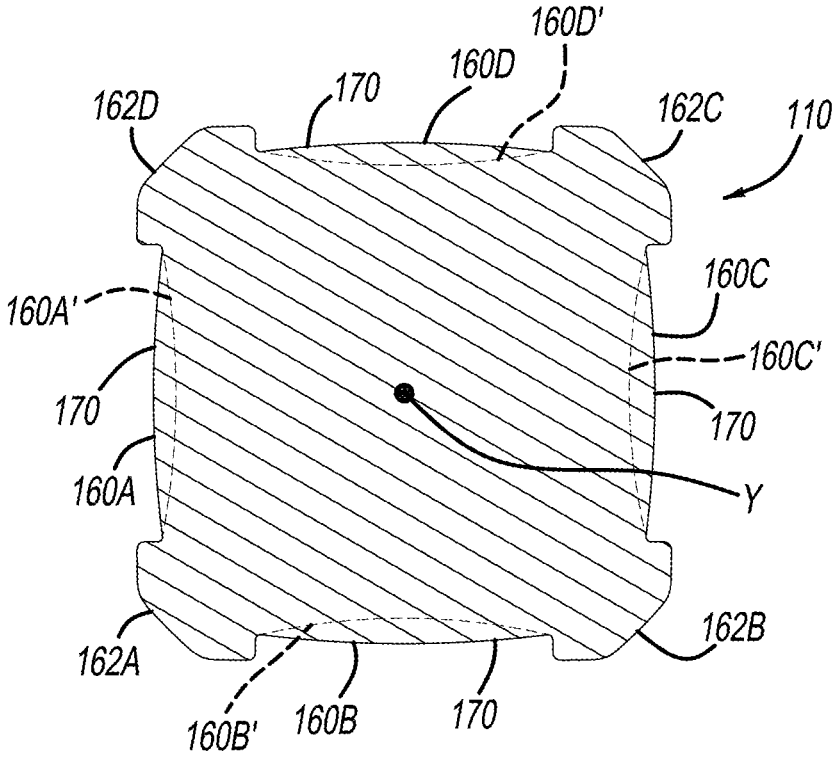
FIG. 13C is a cross-sectional view taken along line 13C-13C of FIG. 9.

The upper panel 170 includes one or more upper panel ribs 180, and the lower panel 172 includes one or more lower panel ribs 182. The upper and lower panel ribs 180 and 182 can be configured in any suitable manner to permit the upper and lower panels 170 and 172 to flex inward in response to a vacuum, and flex outward in response to the container 110 being subject to increased internal pressure without causing unwanted permanent deformation of the container 110. Any suitable number of the upper and the lower panel ribs 180 and 182 can be included, and the number of the upper panel ribs 180 can be different than the number of lower panel ribs 182. For example and as illustrated, three upper panel ribs 180 and three lower panel ribs 182 are included. The upper and the lower panel ribs 180 and 182 each extend outward and away from the longitudinal axis Y to any suitable distance. This is in contrast to the upper and lower panel ribs 80 and 82 of the container 10, which extend into the upper and lower panels 70 and 72 towards the longitudinal axis A, and are thus recessed within the upper and lower panels 70 and 72. The upper and lower panel ribs 180 and 182 of the container 110 extend lengthwise in a direction generally perpendicular to the longitudinal axis Y. As described further herein and as illustrated in FIGS. 13A-13C, each one of the upper and lower panel ribs 180 and 182 are rounded such that each one of the upper and lower panel ribs 180 and 182 protrudes furthest from the upper and lower panels 170 and 172 at generally a midpoint along each of their lengths.

Between the upper panel 170 and the neck 130 is an upper rib 190. Between the lower panel 172 and the second end 114 is a lower rib 192. Between the upper panel 170 and the lower panel 172 is an intermediate rib 194. Each one of the upper, lower, and intermediate ribs 190, 192, and 194 are recessed into the container 110, and specifically the outer surface 164 thereof. The upper, lower, and intermediate ribs 190, 192, and 194 extend laterally in a direction generally perpendicular to the longitudinal axis Y and parallel to the horizontal axis X. The upper, lower, and intermediate ribs 190, 192, and 194 further allow the sidewalls 160A-160D to resist expansion and deformation when under pressure, and absorb vacuum forces in order to resist container skewing, thereby helping the container 110 to maintain its intended shape.

The upper, lower, and intermediate ribs 190, 192, and 194 provide numerous advantages. For example, during the blow-molding process, the upper rib 190, the lower rib 192, and the intermediate rib 194, each of which extend into the container 110, advantageously trap the material of the container 110, which results in less material in other areas of the container 110. The upper and lower panel ribs 180 and 182, which extend outward, allow the material of the container 110 to be better distributed to more important areas of the container 110. The container 110 generally provides a solid ring about the container 110 proximate to the intermediate rib 194, which strengthens the container 110 in order to resist outward movement. The inwardly extending intermediate rib 194, on the other hand, facilitates material distribution and improves vacuum response.

Each one of the first, second, third, and fourth sidewalls 160A-160D can include the upper panel 170 and the lower panel 172, as well as the upper, lower, and intermediate ribs 190, 192, and 194 described above in the same or substantially similar configuration. The upper and lower panels 170 and 172, as well as the upper, lower, and intermediate ribs 190, 192, and 194 can be scalable for different sized containers. The upper and lower panel ribs 180 and 182 can also be scalable for different sized containers, and any suitable number of the upper and lower panel ribs 180 and 182 can be included.

The upper and lower panels 170 and 172, the upper and lower panel ribs 180 and 182 thereof, and the upper, lower, and intermediate ribs 190, 192, and 194 can be configured in any suitable manner in order to funnel internal pressure against the sidewalls 160A-160D to the area of the sidewalls 160A-160D at and proximate to the horizontal axis X, which extends along the intermediate rib 194, where the sidewalls 160A-160D are generally the strongest in order to resist unwanted deformation of the sidewalls 160A-160D. For example, providing the upper and lower panels 170 and 172 with the trapezoidal shape illustrated and described above in which the upper and lower panels 170 and 172 are widest at the respective lower and upper ends 174B and 176A funnels pressure to the center portions of the sidewalls 160A-160D between the upper and lower panels 170 and 172. Furthermore, configuring the upper and lower panel ribs 180 and 182 such that the ribs 180 and 182 increase in length with the longest rib 180 and 182 being proximate to the horizontal axis X and the shortest rib 180 and 182 being distal to the horizontal axis X further funnels pressure towards the center of the sidewalls 160A-160D at or proximate to the horizontal axis X and the intermediate rib 194.

Figure 12:
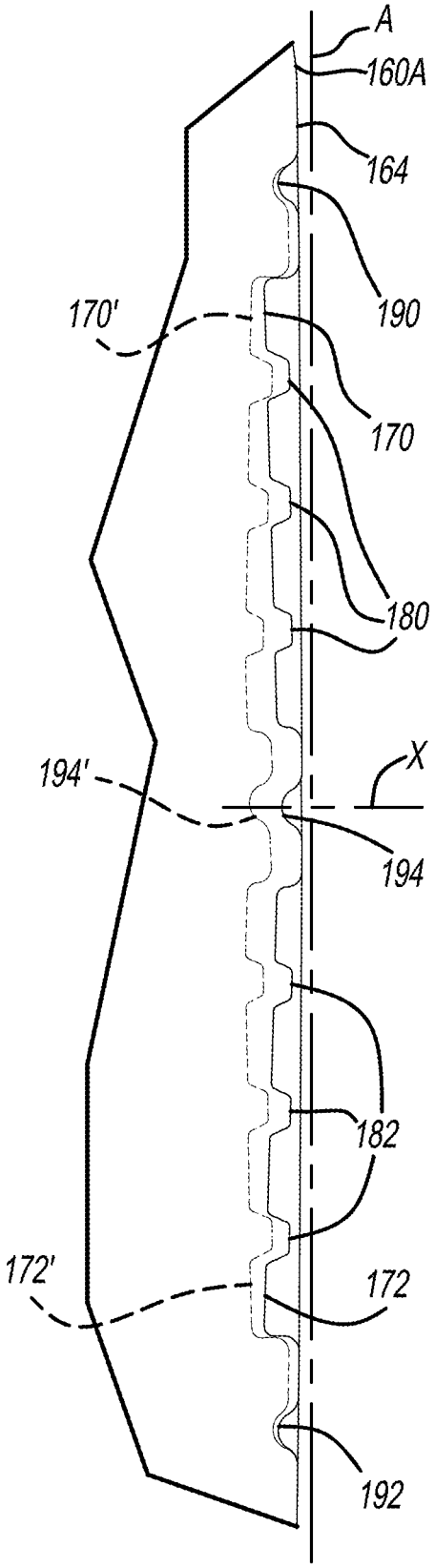
FIG. 12 is a cross-sectional view taken along line 12-12 of FIG. 11.

With reference to FIG. 12, for example, each sidewall 160A-160D generally bows outward or is generally convex as blown (i.e., before filling, before being subject to filling pressure, and before being subject to vacuum) such that each sidewall 160A-160D is furthest from the longitudinal axis Y at, and thus has an apex at, the intermediate rib 194 and along horizontal axis X. For example, FIG. 12 is a cross-sectional view of the sidewall 160A taken along line 12-12 of FIG. 11 and includes a vertical reference line A that extends parallel to longitudinal axis Y and is perpendicular to horizontal axis X. The vertical reference line A is positioned to generally abut the outer surface 164 of the sidewall 160A at the intermediate rib 194. Thus as blown, the sidewall 160A is closest to the vertical reference line A proximate to the horizontal axis X and the intermediate rib 194, and gradually tapers away from the vertical reference line A towards the longitudinal axis Y as the sidewall 160A extends both above and below the vertical reference line A. On the upper side of the horizontal axis X, the sidewall 160A is furthest from the vertical reference line A within the upper panel 170 proximate to the upper end 174A. On the lower side of the horizontal axis X, the sidewall 160A is furthest from the vertical reference line A within the lower panel 172 proximate to the lower end 176B. Such an arrangement provides for enhanced pressure control, and forces internal pressures to the area where each sidewall 160A-160D is strongest, such as at and proximate to the intermediate rib 194 and horizontal axis X, which also provides for a controlled vacuum response after the container 110 is filled, capped, and cooled under vacuum.

After the container 110 is filled (such as hot filled), capped, cooled, and placed under vacuum, the sidewalls 160A-160D flex inward towards the longitudinal axis Y so as to move from the convex as blown position to a concave position. As illustrated in FIG. 12 for example, the upper panel 170 and the lower panel 172 each move inward and away from the vertical reference line A (and thus towards the longitudinal axis Y) to a concave position at reference numbers 170' and 172' respectively. The intermediate rib 194 also moves away from the vertical reference line A (and thus towards the longitudinal axis Y) along horizontal axis X to an inward position at reference numeral 194'.

With reference to the cross-sectional views of FIGS. 13A-13C, as blown the sidewalls 160A-160D are generally rounded and bow outward from side-to-side to further resist internal pressures. Thus as blown, the sidewalls 160A-160D do not extend linearly between the chamfered edges 162A-162D, but rather curve outward and then back inward such that each sidewall 160A-160D is furthest from the longitudinal axis Y at a mid-point along the width thereof. With specific reference to FIG. 13A for example, the upper panel 170 is curved along its entire width and is furthest from longitudinal axis Y at a mid-point thereof between neighboring chamfered edges 162A-162D. The upper and lower panel ribs 180 and 182 are also curved as they extend across the width of the upper and lower panels 170 and 172. With reference to FIG. 13B, the lower panel 172 is curved along its entire width, including along the lower panel rib 182, such that the lower panel rib 182 is furthest from the longitudinal axis Y at a midpoint along the length thereof. Each of the other upper and lower panel ribs 182 and 184 are curved along their lengths as well. With reference to FIG. 13C, the upper panel 170 has the greatest degree of curvature proximate to the upper end 174A. This is in part because, as blown, each of the sidewalls 160A-160D taper inward as they extend away from (above and below) the horizontal axis X. Accordingly, each one of the sidewalls 160A-160D curve more along the widths thereof at areas distal to the horizontal axis X than at the horizontal axis X, with the greatest degrees of curvature being proximate to the neck 130 and the second end 114. After the container 110 is filled (such as hot filled), capped, cooled, and placed under vacuum, the sidewalls 160A-160D flex inward towards the longitudinal axis Y so as to move from the convex as blown position to the concave position as illustrated in FIGS. 13A-13C at reference numerals 160A'-160D', for example.

Figure 14A:
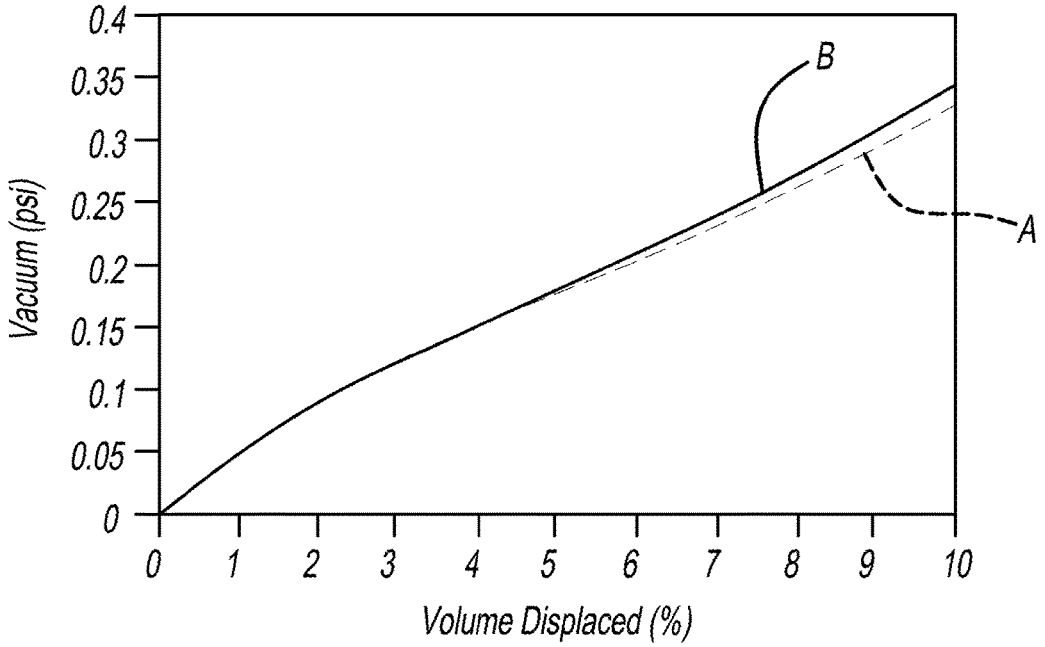
FIG. 14A is a graph showing changes in volume of the container of FIG. 9 when subject to different vacuum pressures, as compared to a different container.
Figure 14B:
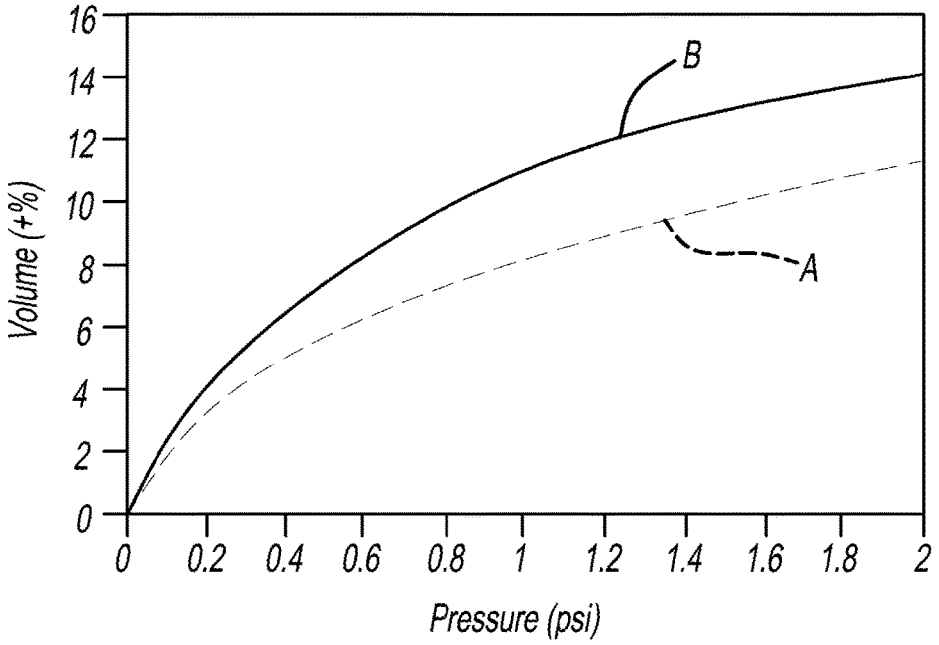
FIG. 14B is a graph showing changes in volume of the container of FIG. 9 when subject to different internal pressures, as compared to a different container.

FIG. 14A is a graph illustrating performance of the container 110 at line A, versus the container 10 at line B. As the container 110 is subjected to increased vacuum pressure, the volume displaced of the container 110 is advantageously generally the same as the volume displaced of the container 10, for example, as can be seen by comparing line A to line B of FIG. 14A. Thus under vacuum the container 110 at 64 ounces performs in a manner very similar to, or the same as, the much smaller container 10 of 12 ounces. FIG. 14B is a graph illustrating performance of the container 110 under increased pressure as compared to container 10. As the pressure increases, the container 110 advantageously undergoes a much smaller percentage volume increase as compared to the container 10, as can be seen by comparing line A to line B.

The container 110 thus provides numerous advantages in addition to those set forth above, including improved pressure performance. For example and as compared to other containers, such as the container 10, the container 110 exhibits the following advantages: the container 110 is more resistant to pressure; exhibits lower expansion under pressure; exhibits no permanent deformation at the sidewalls 160A-160D upon release of pressure therein; has more stabilized sidewalls 160A-160D, etc.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure.

The terminology used is for the purpose of describing particular example embodiments only and is not intended to be limiting. The singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). The term "and/or" includes any and all combinations of one or more of the associated listed items.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A container including at least one sidewall comprising:

a first vacuum panel recessed beneath an outer surface of the sidewall;

a second vacuum panel recessed beneath the outer surface of the sidewall, the second vacuum panel spaced apart from, and vertically aligned with, the first vacuum panel;

a plurality of first ribs protruding outward from the first vacuum panel away from a longitudinal axis of the container; and a plurality of second ribs protruding outward from the second vacuum panel away from the longitudinal axis of the container;

wherein the sidewall is convex at the outer surface of the sidewall such that the sidewall extends outward to an apex of the sidewall located between the first vacuum panel and the second vacuum panel.

2. The container of claim 1, wherein the first vacuum panel and the second vacuum panel are mirror images of each other.

3. The container of claim 2, wherein both the first vacuum panel and the second vacuum panel have a trapezoid shape.

4. The container of claim 1, further comprising: an intermediate rib between the first vacuum panel and the second vacuum panel, the intermediate rib extending into the sidewall directly from the outer surface of the sidewall; an upper rib extending into the sidewall between the upper vacuum panel and a neck of the container; and a lower rib extending into the sidewall between the lower vacuum panel and a base of the container.

5. The container of claim 1, further comprising an intermediate rib between the first and the second vacuum panels extending into the sidewall at the apex of the sidewall.

6. The container of claim 1, wherein: the plurality of first ribs have progressively longer lengths, a longest one of the plurality of first ribs is closest to the second vacuum panel; and the plurality of second ribs have progressively longer lengths, a longest one of the plurality of second ribs is closest to the first vacuum panel.

7. The container of claim 1, wherein the sidewall includes a convex width such that the sidewall protrudes furthest outward relative to an interior of the container at a midpoint along the convex width of the sidewall when the container is in an as blown configuration prior to being filled and being subject to filling pressure.

8. The container of claim 1, wherein the container has a capacity of 64 ounces.

9. The container of claim 1, wherein the container has exactly four sidewalls.

10. The container of claim 9, wherein the sidewalls are connected by edges including at least one of a chamfer and a radius.

11. A container including at least one sidewall comprising:

a first vacuum panel recessed beneath an outer surface of the sidewall;

a second vacuum panel recessed beneath the outer surface of the sidewall, the second vacuum panel spaced apart from, and vertically aligned with, the first vacuum panel;

an intermediate rib between the first and the second vacuum panels, the intermediate rib extending inward from the outer surface;

a plurality of first ribs of varying lengths protruding from the first vacuum panel such that a longest one of the plurality of first ribs is closest to the intermediate rib; and a plurality of second ribs of varying lengths protruding from the second vacuum panel such that a longest one of the plurality of second ribs is closest to the intermediate rib;

wherein the sidewall is convex at the outer surface of the sidewall such that the sidewall extends outward to an apex of the sidewall located between the first vacuum panel and the second vacuum panel.

12. The container of claim 11, wherein the sidewall is convex in a lengthwise direction at the outer surface thereof when the container is in an as blown configuration prior to being filled and being subject to filling pressure.

13. The container of claim 11, wherein the sidewall is convex in a widthwise direction at the outer surface thereof when the container is in an as blown configuration prior to being filled and being subject to filling pressure.

14. The container of claim 11, wherein each one of the plurality of first and second ribs is convex in a lengthwise direction.

15. The container of claim 11, further comprising an upper rib extending inward from the outer surface between the first vacuum panel and a neck of the container, and a lower rib extending inward from the outer surface between the lower vacuum panel and a base of the container.

16. A container including at least one sidewall comprising:

a first vacuum panel recessed beneath an outer surface of the sidewall;

a second vacuum panel recessed beneath the outer surface of the sidewall, the second vacuum panel spaced apart from, and vertically aligned with, the first vacuum panel;

a plurality of first ribs protruding outward from the first vacuum panel away from a longitudinal axis of the container; and a plurality of second ribs protruding outward from the second vacuum panel away from the longitudinal axis of the container;

wherein the container is larger than 18.5 ounces;

wherein when the container is in an as blown configuration prior to being filled and being subject to filling pressure:

the sidewall is convex in a lengthwise direction at the outer surface thereof;

the sidewall is convex in a widthwise direction at the outer surface thereof;

the sidewall is convex at the outer surface of the sidewall such that the sidewall extends outward to an apex of the sidewall located between the first vacuum panel and the second vacuum panel; and wherein after the container is hot filled, capped, cooled, and under vacuum: the sidewall is concave in the lengthwise direction at the outer surface thereof; and the sidewall is concave in the widthwise direction at the outer surface thereof.

17. The container of claim 16, further comprising; an intermediate rib between the first and the second vacuum panels, the intermediate rib extending inward from the outer surface; an upper rib extending inward from the outer surface between the first vacuum panel and a neck of the container; a lower rib extending inward from the outer surface between the lower vacuum panel and a base of the container; a plurality of first ribs of varying lengths protruding from the first vacuum panel such that a longest one of the plurality of first ribs is closest to the intermediate rib; and a plurality of second ribs of varying lengths protruding from the second vacuum panel such that a longest one of the plurality of second ribs is closest to the intermediate rib.

18. The container of claim 16, wherein the container is a 64 ounce container having exactly four sidewalls.

* * * * *